US005680816A

United States Patent [19]

White et al.

[11] Patent Number: 5,680,816

[45] Date of Patent: Oct. 28, 1997

[54] LIVE SHAFT OSCILLATOR FOR LITHOGRAPHIC PRESS DAMPENER

[75] Inventors: Arthur H. White, Washington Township; Robert Wall, Prospect Park, both of N.J.

[73] Assignee: Varn Products Company, Inc., Oakland, Nev.

[21] Appl. No.: 723,184

[22] Filed: Sep. 27, 1996

[51] Int. Cl.[6] ..... B41F 31/14; B41L 27/16

[52] U.S. Cl. ..... 101/148; 101/DIG. 38

[58] Field of Search ..... 101/148, 147, 101/DIG. 38, 348, 349, 350, 205–209, 363, 351, 352; 118/259, 260, 261

[56] References Cited

U.S. PATENT DOCUMENTS

| | | | |
|---|---|---|---|
| 4,455,938 | 6/1984 | Loudon | 101/148 |
| 4,981,077 | 1/1991 | Alvarez | 101/350 X |
| 5,134,935 | 8/1992 | Hayes et al. | 101/148 |

*Primary Examiner*—J. Reed Fisher

[57] ABSTRACT

In a continuous dampening system, an oscillating distributor roller distributes ink/dampening fluid emulsion preferably over the form roller. The drive for causing distributing motion, back and forth along its axis of rotation, of the distributor roller is derived by friction drive to the roller surface and the support shaft of the distributor roller is also rotatably driven through appropriate gearing, thus rotation of the distributor roller is varied along with the rotational speed of the other rollers of the dampener, but the rate of longitudinal oscillation remains relative, since the speed of relative motion between the shaft and distributor roller itself increases or decreases proportionately as the press and dampener speed up and slow down. The distributor roller is held and controlled within a sub-frame structure with adjustments to achieve a uniform "stripe" contact between the distributor roller and the form roller, and the distributor roller can be moved, without disturbing its fine adjustment or trim, between an active position contacting the form roller and a inactive position where the distributor roller is out of contact with the form roller.

5 Claims, 7 Drawing Sheets

LIVE SHAFT OSCILLATOR FOR LITHOGRAPHIC PRESS DAMPENER

FIELD OF THE INVENTION

This invention relates to dampening systems for lithographic printing presses.

BACKGROUND OF THE INVENTION

The invention is an improvement on the continuous dampening system and apparatus disclosed in U.S. Pat. No. 4,455,938 issued 26 Jun. 1984, and in U.S. Pat. Nos. 4,981,077 issued 1 Jan. 1991 and 5,134,935 issued 4 Aug. 1992.

In said U.S. Pat. Nos. 4,455,938 an improved lithographic dampener is disclosed in which the resilient surface of a motoring roller is pressed against a resilient form roller surface, and the rollers are driven at the same surface speed in a direction to define an open nip through which the roller surfaces descend. Seals engage the surfaces of these rollers, near their ends to define a pool into which dampening liquid is supplied. In said U.S. Pat. No. 5,134,935 a shallow pan contains a dampening liquid supply into which the metering roller dips, at a controlled level. The pan extends under and beyond the motoring and form rollers' nip, and in a rearward direction extends substantially beyond the rear or back plate of the dampener structure. In that patent an oscillating distributor roller runs in contact with the motoring roller, and functions to spread or smear the ink/liquid mixture on the motoring roller surface, before the mixture is carried over the top of the motoring roller into the nip.

The oscillator roller derives it rotational force from friction contact with the motoring roller, and is supported on a stationary shaft which includes a reversing helical track or cam. A follower button on the interior of the oscillator roller engages the track, producing a reversing side-to-side longitudinal motion of the oscillator roller. At the same time, the oscillator roller is pressed against the metering roller and performs the additional function of metering the amount of additional dampening liquid carried to the nip from the pool. As the rotational speed of the metering roller varies, so does the rotational speed of the oscillator roller and likewise the speed of its reversing longitudinal spreading action against the metering roller. If the press speed (and thus the dampener roller speeds) become quite high, the loading on this cam and follower mechanism will become excessive and durability of this mechanism will reduce significantly.

SUMMARY OF THE INVENTION

In a continuous dampening system, an oscillating distributor roller is employed to distribute the ink-dampening fluid emulsion evenly over the form roller, rather than the metering roller. According to the invention, the power drive for causing the oscillating motion (back and forth along its axis of rotation) of this distributor roller is a combination of rotational force derived by gear train connection of a "live" distributor roller shaft to the dampener drive, and by the frictional drive of the distributor roller from the form roller.

Thus, the support shaft of the distributor roller is rotatably driven, instead of stationary, and the rotation of the distributor roller is varied along with the rotational speed of the other rollers of the dampener due to the fact that the speed of relative motion between the shaft and the distributor roller remains at the same ratio as the press and dampener speed up and slow down. This keeps the loading on the reversing mechanism (cam and follower) within acceptable limits even though the press may be operating at web press speeds which can approach 330 impressions per minute.

The distributor roller shaft is supported in and between oscillator end frames which, in turn, are interconnected by a tie bar and are pivotally supported between the dampener main side frames. The distributor roller thus is held and controlled within a sub-frame structure with adjustments to achieve a uniform "stripe" contact between the distributor roller and the form roller. There is also a control which easily moves the distributor roller (without disturbing its fine adjustment or trim) between an active position contacting and acting against the form roller and a withdrawn or inactive position, wherein the distributor roller is out of contact with the form roller and the distributing function is not used.

It is therefore an object of the invention to provide, in a continuous contact lithographic dampener, a distributor roller and its drive which will oscillate at acceptably lower speeds, using an economical drive mechanism, at the higher rotational speeds encountered in web press operations; a further object is to provide a convenient arrangement for disabling the function of the distributor when desired.

Other objects and advantages of the invention will be apparent from the following description, the accompanying drawings and the appended claims.

DESCRIPTION OF THE PREFERRED EMBODIMENT

Figure 1A:
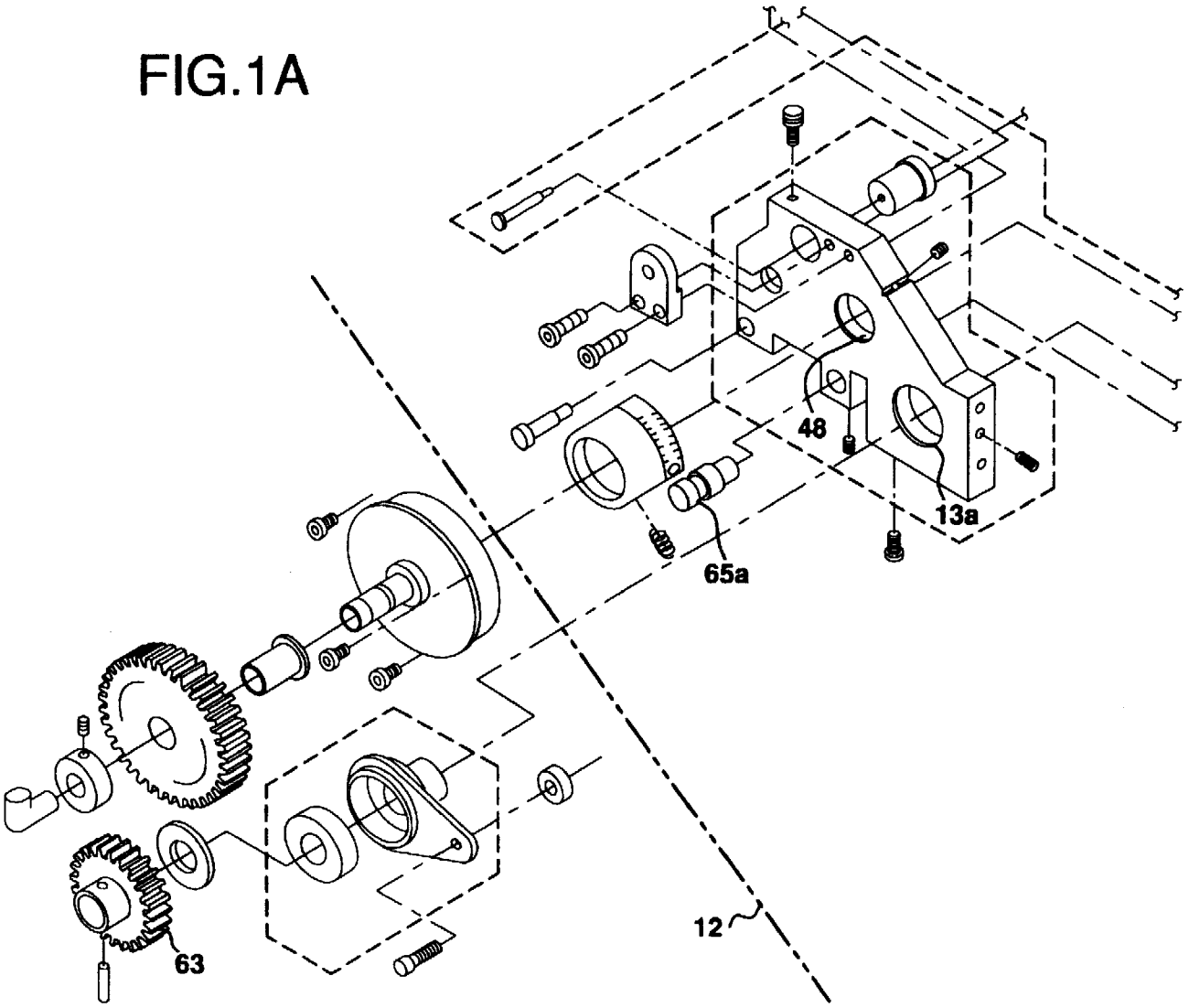
FIGS. 1A, 1B, and 1C, taken together, are an over-all exploded perspective view of the dampening system according to the invention.
Figure 1B:
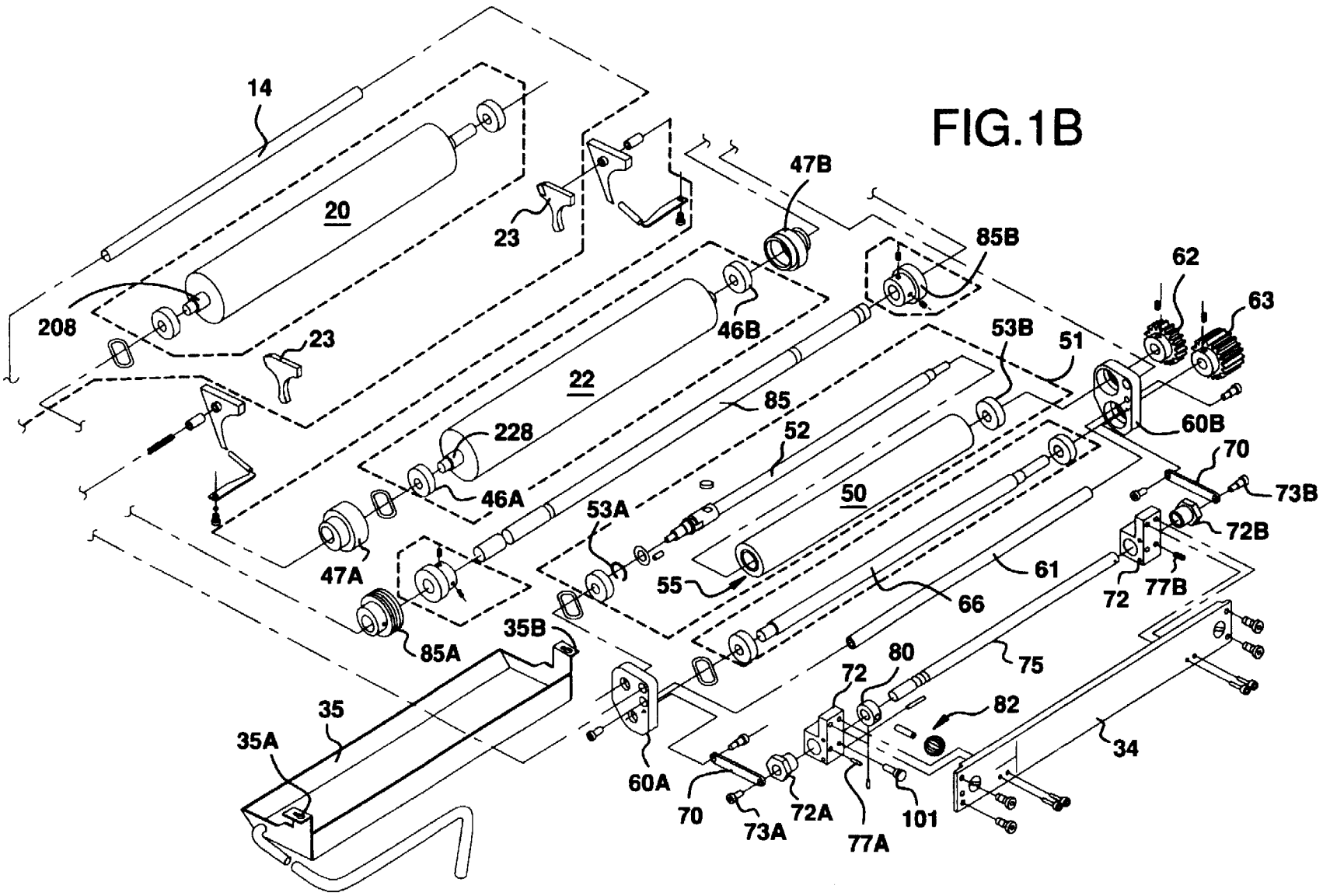
Figure 1C:
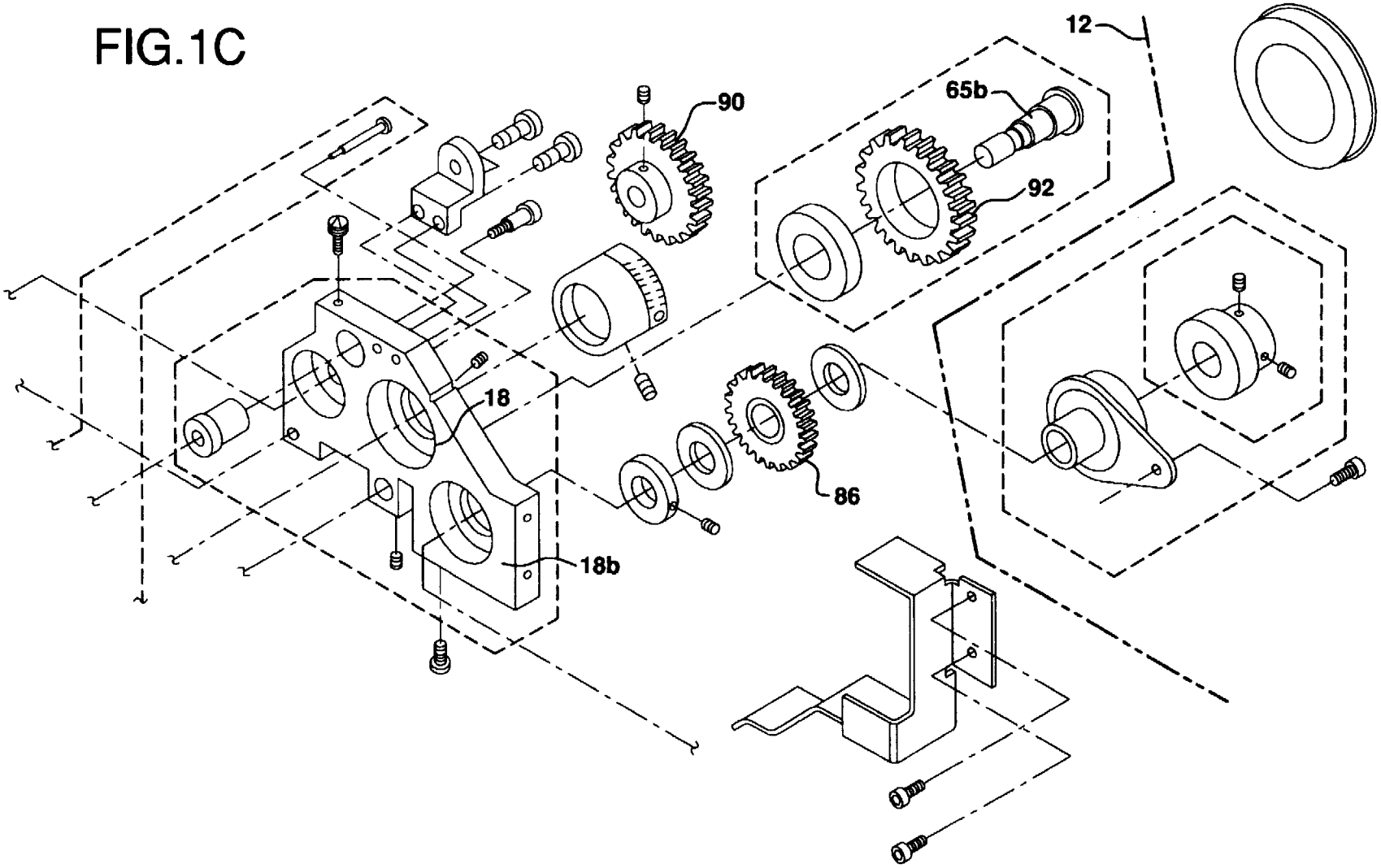
Figure 4:
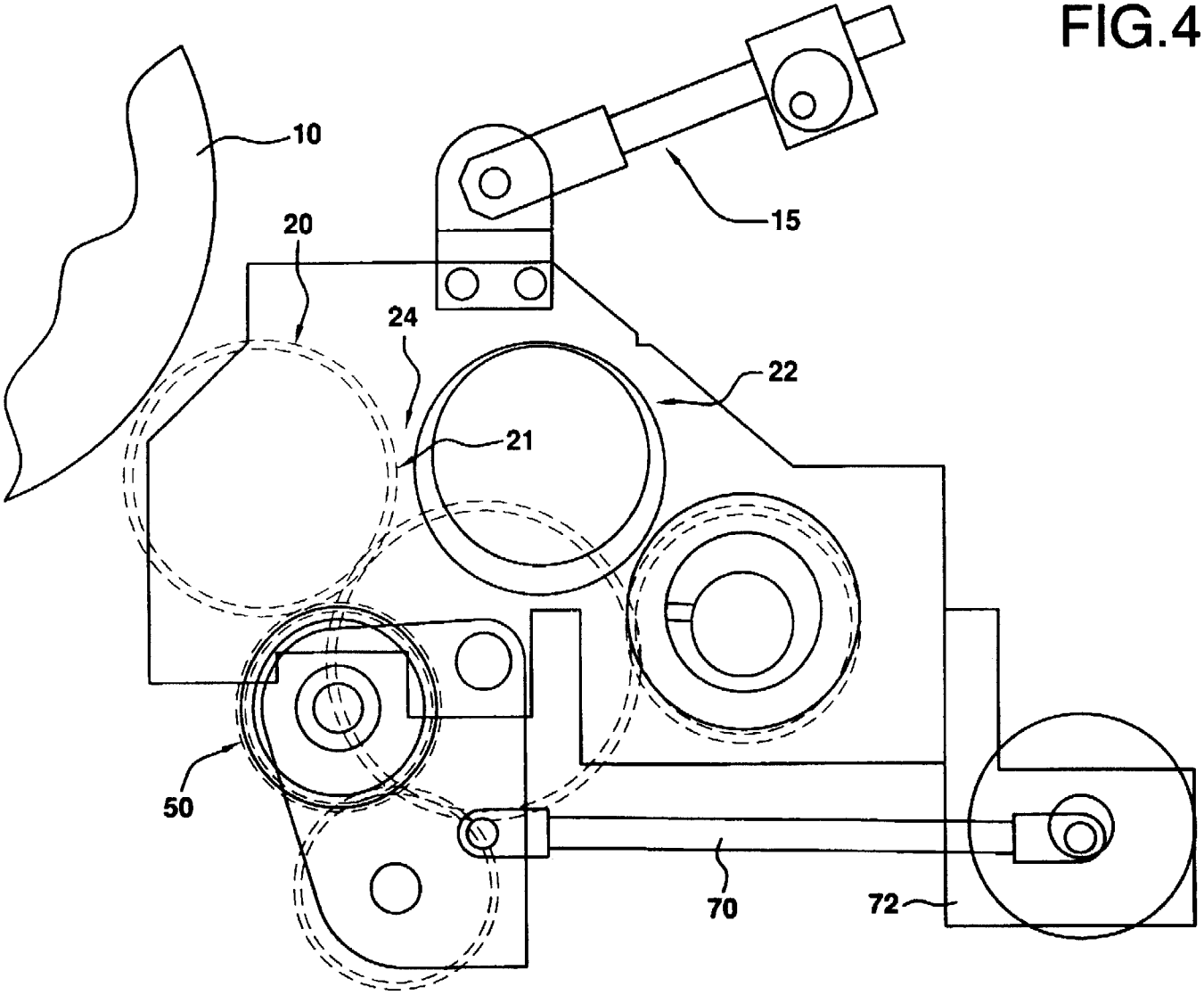
FIG. 4 is a schematic side view of the dampening system, as seen from the left or foreground of FIG. 1.

FIGS. 1 and 4 depict a preferred embodiment of the dampening apparatus. The press includes a plate cylinder 10 with an attached drive gear 11 supported within the press framework 12, generally as in U.S. Pat. No. 4,981,077. The dampening apparatus itself is enclosed within a frame including side frame members 13A, 13B with tie bar 14 and tie plate 34 connecting the side frame members. The dampening apparatus is attached to the press housing in a conventional manner, as illustrated and described in said U.S. Pat. No. 5,134,935. Pressure between the plate cylinder 10 and a form roller 20 is adjusted through the attachment 15.

The dampener comprises as major elements form roller 20 supported on (and fixed to) a shaft 20S, and the metering roller 22 (on its shaft 22S) which are always in contact during operation and which counter-rotate such that there is an upward facing inward nip 21 (FIG. 4) at their juncture, and above which reservoir 24 is formed by these rollers and seals 23 near the ends of the nip 21. Form roller 20 contacts the lithographic plate (not shown) on plate cylinder 10 so as to apply the ink-dampening fluid emulsion evenly over the plate or "form", as is well known. Dampening liquid is replenished in reservoir 34 from a remote supply bottle (not shown), in known fashion.

The plate cylinder has gear 11 at one of its sides, driving successive idler gears 25 and 26 which are each mounted on stub shafts from side frame 13A. The ratios of these gears are such that the surface velocities of the plate cylinder and the form roller surface are equal. At the opposite side of the dampener frame, a mating pair of gears (later described), of equal size, are fixed to the shafts of the form roller and metering roller, so these two rollers counter-rotate in unison, e.g. same surface velocity. The idler gear 25 drives a gear 84 on a transverse drive shaft 85 (both later described, see FIG. 5).

At the bottom of side frames 13A, 13B there is a shallow drip catching pan 35 which has brackets 35A and 35B attached to the bottom of side frame members 13. The drip pan extends forward under the form roller 20, and rearward adjacent end or tie plate 34.

The metering roller 22 is supported in bearings 46A and 46B at its opposite ends, with the metering roller surface normally engaging the surface of form roller 20. Bearings 46A and 46B have eccentric outer carriers received 47A, 47B in the respective bores 48 in side frame members 13A, 13B, and rotation of these carriers will control the adjustment of the metering roller contact with form roller 20.

Thus, the rollers 20 and 22 are comparable to the form roller and metering roller as described in said U.S. Pat. No. 4,455,938, and act to mix or mill the dampening liquid/ink mixture on the roller surfaces. The surface of form roller 20 is formed of a suitable rubber-like material, and is more soft or resilient than the surface of metering roller 22, as is explained in the prior patents identified above. Thus, eccentric carriers 47A, 47B may be operator adjusted to produce a desired pressure at the form roller/metering roller nip and this will result in some deformation of the form roller surface at such nip. If the region above the dampener structure is to be open to operator access during operation a cover (not shown) may be added over the dampener rollers.

Figure 5:
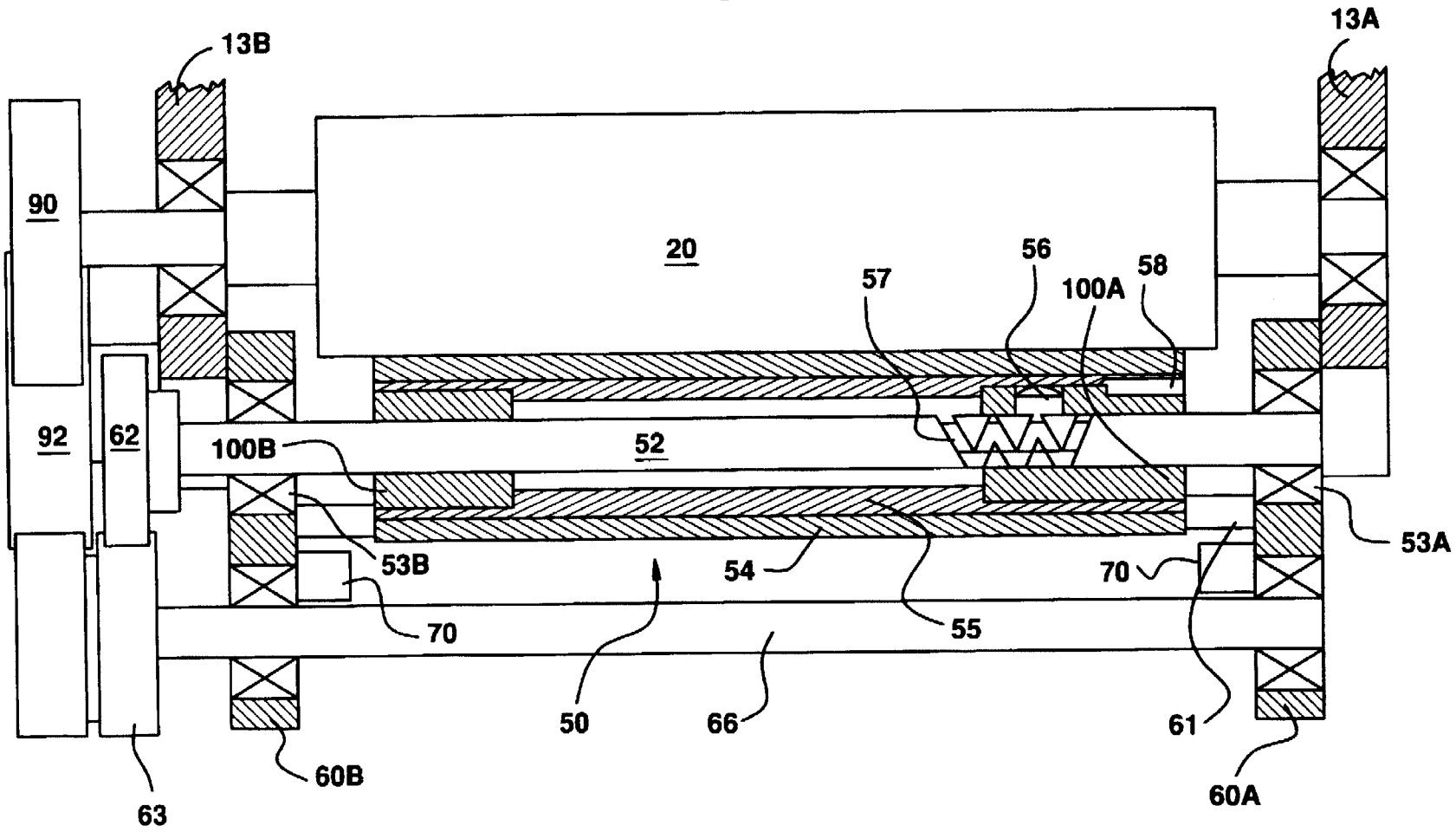
FIG. 5 is a schematic view of the oscillating distributor roller.

An oscillating distributor roller 50 is provided to work against the underside of form roller 20, as opposed to contacting the metering roller as shown in said U.S. Pat. No. 5,134,935. The interior of the oscillator roller is shown in FIG. 5, and the overall mechanism appears within dotted outline 51 in FIG. 1.

The distributor roller drive and support shaft 52 has bearings 100A, 100B at its opposite ends which are fitted into and supporting the tubular body 55 of roller 50, which in turn carries the outer roller sleeve 54. Bearing 100A carries a follower button 56 thereon, which button engages a reversing helical track or cam 57 formed on shaft 52. As the oscillator roller body 55 turns due to friction drive from the form roller, button 56 moves along track 57, since the bearing 100A is held to body 55 by pin 58, causing a side-to-side excursion of roller body 55 in a known manner. This produces a spreading action of the mixed ink and dampening liquid on the form roller surface.

Roller 50 is supported between oscillator end frame parts 60A, 60B which are interconnected by a tie bar 61 and receive the distributor shaft bearings 53A, 53B. At the right side (FIG. 1) shaft 52 extends through bearing 53B and is fitted with a drive gear 62. In addition, an idler shaft 66, supported in end frame parts 60, extends parallel to the distributor roller 50 and has an end projecting through the right hand frame part 60B, carrying an idler gear 63 which meshes with drive gear 62. The purpose of idler gear 63 is to provide the required rotational direction of the shaft drive gear 62, as is later described.

The end frame parts 60A, 60B, idler shaft 66, and tie bar 61 provide a subframe which is pivotally supported between the main side frames 13 on pins 65A, 65B. The distributor roller thus is held and controlled within a sub-frame structure with can be adjusted to achieve a uniform "stripe" contact between distributor roller 50 and form roller 20.

A pair of links 70 are pivotally connected to each of the end frame parts 60, to control the swinging (or pivotal) adjustment of the distributor roller 50 against the form roller 20. End caps or brackets 72 are secured to the forward ends of the side frames 13, and are connected by a tie plate 34 at the front of the dampener structure. Each end cap carries a rotatable bushing 72A, 72B through which extend shouldered screws 73A, 73B that thread into the distributor eccentric shaft 75. Screws 73A, 73B enter the ends of shaft 75 spaced from the shaft central axis, and the ends of shaft 75 extend through bushings 72A, 72B, so rotary motion of shaft 75 will cause forward/backward motion of links 70. Set screws 77A, 77B are threaded into end caps 72 and press on bushings 72A, 72B to retain them in an adjusted position. Thumbscrew 101 is threaded into either endcap to retain the setting of the distributor roller 50.

In addition, a collar 80 with a handle 82 is fastened to one end of eccentric shaft 75 to control rotation of that shaft. If thumbscrew 101 is released, handle 82 can be moved to adjust the rotational position of shaft 75, both as to determining the pressure of distributor roller 50 against form roller 20, and to withdraw the entire subframe far enough from the form roller to put distributor roller 50 into a non-operative position.

Figure 2:
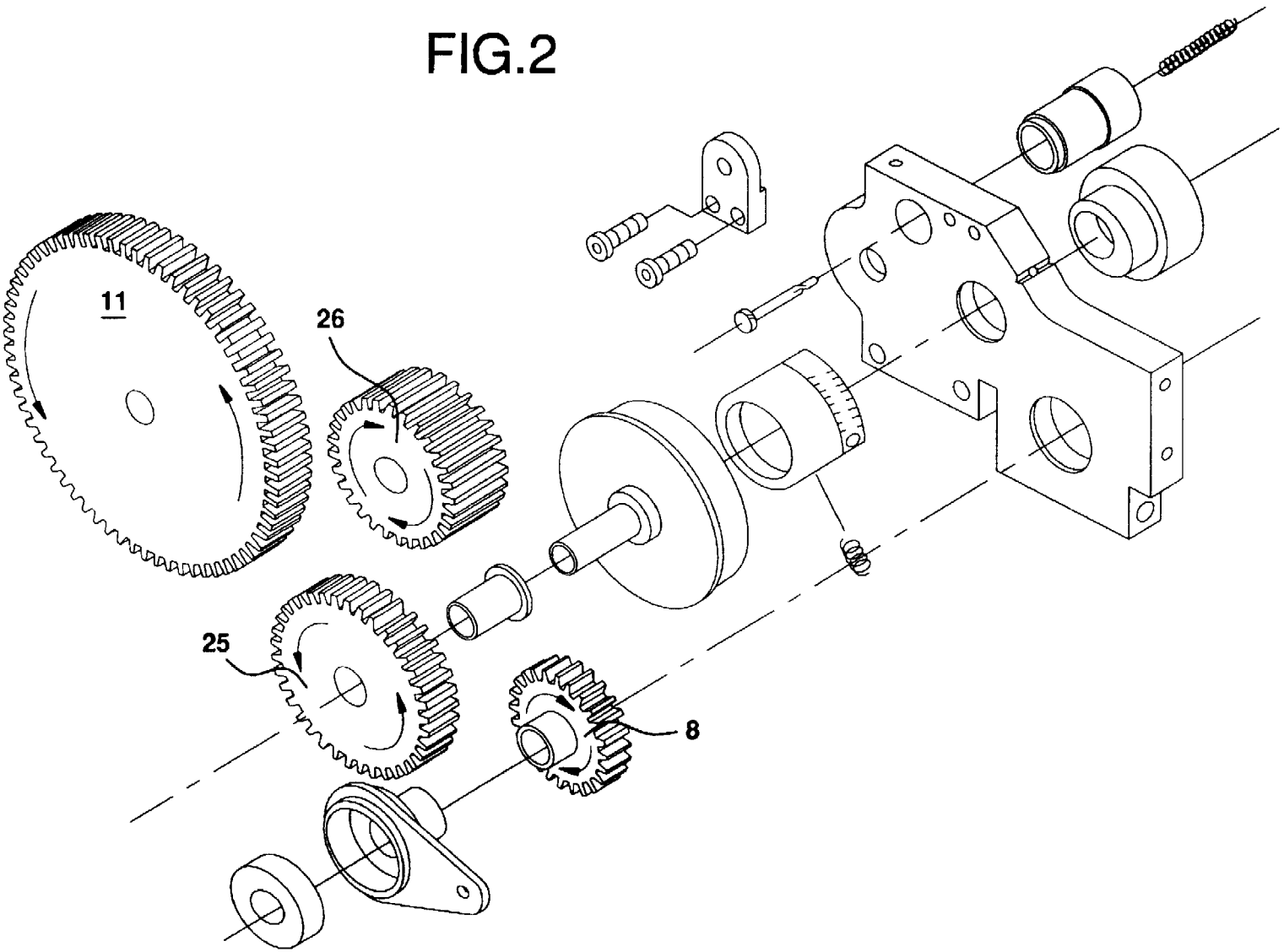
FIGS. 2 and 3 are enlarged partial perspective views of the gearing which is part of the drive shown in FIG. 1.
Figure 3:
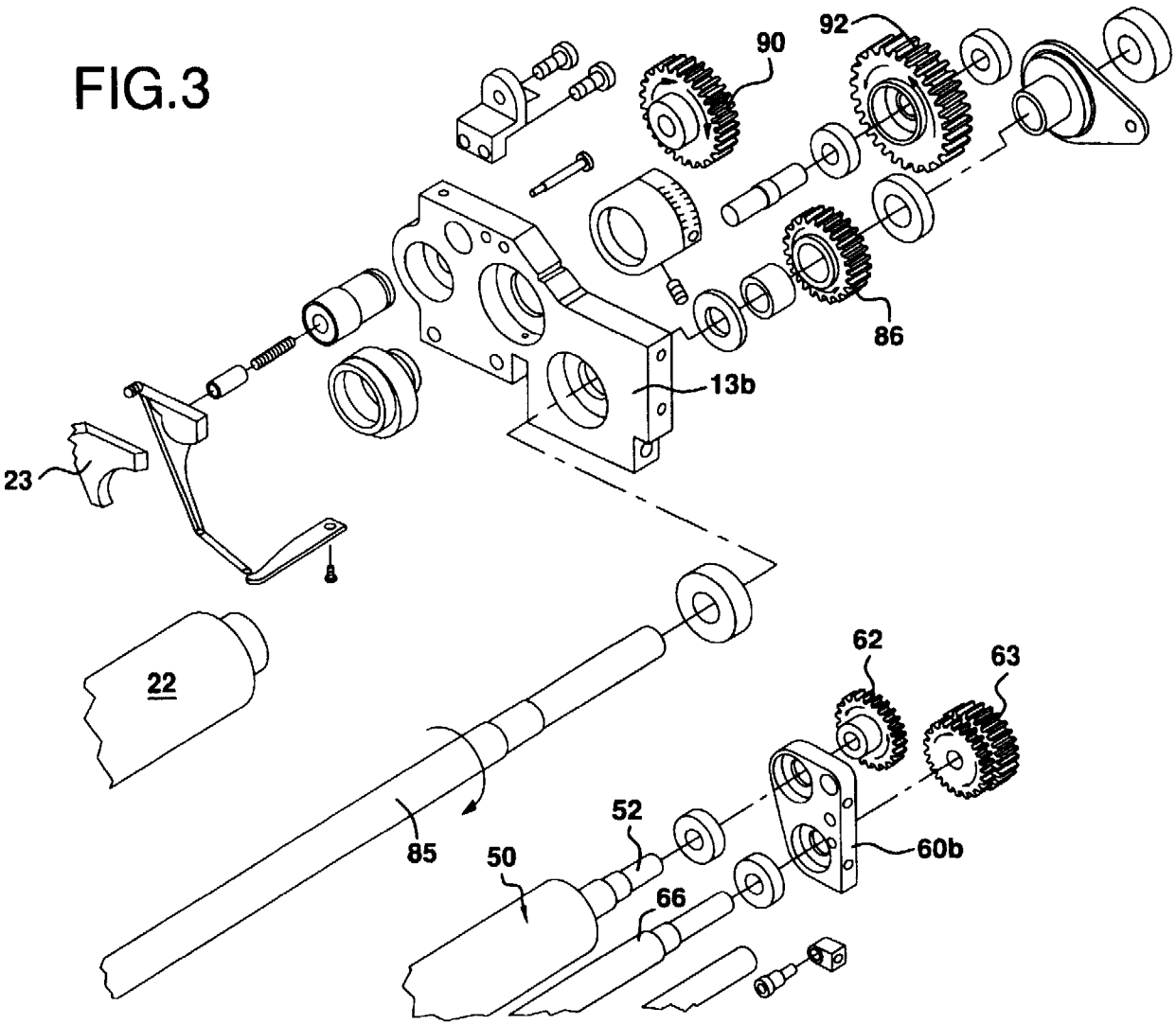

Referring to FIGS. 2, 3 and 4, the drive path for the dampener is from form cylinder gear 11 to idler gears 26 and 25. Gear 25 drives gear 84 which is secured to a drive shaft 85 extending transversely of the dampeners, and supported in the main frames 13 by eccentric bearings 85A, 85B. Drive shaft 85 has fastened to its other (right) end a gear 86 which is outside frame member 13B (see FIGS. 1 & 3) and which meshes with gear 92. Gear 63 meshes with the form roller drive gear 90, and also with gear 63 that in turn drives the gear 62 fitted to distributor shaft 52.

The result of this drive train is that the form and metering rollers are counter-rotating, in pressure contact, and the outer body 55 of the distributor roller 50 is driven by friction contact with form roller 20, while this shaft 52 is driven through the gear train. Thus, as the input speed from gear 25 increases, the rotational velocity of both the distributor body 55 and the shaft 52 likewise increase. Therefore, the relative motion between follower button 56 and track or cam 57 remains essentially constant.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. In a dampener for a lithographic press having spaced apart side frames and a plate cylinder mounted between the side frames, said dampener having a dampener frame including side members spaced apart to fit the press side frames, said dampener frame having a front opening, a form roller rotatably mounted in said dampener frame, a metering roller mounted parallel to said form roller and including adjustable mounting means for pressing said metering roller against said form roller to form a metering roller/form roller nip, seal means contacting the sides of said form roller and metering roller at said nip to confine a quantity of liquid above the nip, an oscillating distributor roller mounted parallel to said form and metering rollers and including means for pressing said distributing roller against one of said form roller and metering roller to drive said distributor roller at approximately the same surface speed as said form and metering rollers; the improvement comprising a distributor drive shaft extending through said distributor roller and a reversing cam on said distributor drive shaft, a follower fixed to the interior of said distributor roller and engaged with said cam providing a means for moving said distributing roller back and forth along its length during rotation thereof, means for rotating said distributor shaft in unison with said metering roller and form roller, and means for supplying dampening liquid to the metering roller.

2. A dampener as defined in claim 1, including means for withdrawing said distributor roller from contact with said one roller to disable the distributing function during operation of the dampener.

3. A dampener as defined in claim 2, wherein said distributor roller is adjustable for parallelism with said one roller, said means for withdrawing said distributor roller being independent of such parallelism adjustment of said distributor roller.

4. A dampener as defined in claim 1, wherein said reversing cam is a dual helical cam track attached to and rotating with said distributor drive shaft, and said follower is a button fixed to the interior of said distributor shaft and extending into contact with said cam track.

5. In a dampener for a lithographic press having a plate cylinder mounted between press side frames, said dampener having a dampener frame including side members spaced part to fit the press side frames, a form roller rotatably mounted in said dampener frame to interface with a form on the plate cylinder, a metering roller mounted in said dampener frame parallel to said form roller and including adjustable mounting means for pressing said metering roller against said form roller to form a metering roller/form roller nip, seal means contacting the sides of said form roller and metering roller at the top of said nip to confine a quantity of liquid above the nip, an oscillating distributor roller mounted in said dampener frame parallel to said form and metering rollers and including means for pressing said distributing roller against one of said form roller and metering roller to drive said distributor roller at approximately the same surface speed as said form and metering rollers; the improvement comprising a distributor drive shaft extending through said distributor roller and a reversing cam on said distributor drive shaft, a follower fixed to the interior of said distributor roller and engaged with said cam providing a means for moving said distributing roller back and forth along said drive shaft during rotation thereof, means for rotating said distributor shaft in unison with said metering roller and form roller, and means for supplying dampening liquid to said metering roller/form roller nip.

* * * * *